US007175118B2

(12) United States Patent
Hockmeyer

(10) Patent No.: US 7,175,118 B2
(45) Date of Patent: Feb. 13, 2007

(54) APPARATUS AND METHOD FOR PROCESSING HIGH VISCOSITY DISPERSIONS

(75) Inventor: Herman H. Hockmeyer, Saddle River, NJ (US)

(73) Assignee: Hockmeyer Equipment Corp., Harrison, NJ (US)

( * ) Notice: Subject to any disclaimer, the term of this patent is extended or adjusted under 35 U.S.C. 154(b) by 114 days.

(21) Appl. No.: 10/865,448

(22) Filed: Jun. 10, 2004

(65) Prior Publication Data

US 2006/0097093 A1 May 11, 2006

Related U.S. Application Data

(63) Continuation-in-part of application No. 10/356,211, filed on Jan. 31, 2003, now abandoned.

(51) Int. Cl.

| | |
|---|---|
| ***B02C 17/16*** | (2006.01) |
| ***B02C 17/00*** | (2006.01) |
| *B02C 17/02* | (2006.01) |
| *B02C 17/10* | (2006.01) |

(52) U.S. Cl. ..... 241/172; 241/46.11; 241/46.17; 241/101.8

(58) Field of Classification Search ..... 241/46.11, 241/46.17, 21, 101.8, 172; 261/93; 417/355, 417/356

See application file for complete search history.

(56) References Cited

U.S. PATENT DOCUMENTS

| | | | | |
|---|---|---|---|---|
| 4,906,577 | A * | 3/1990 | Armstrong et al. | 435/295.3 |
| 5,184,783 | A * | 2/1993 | Hockmeyer et al. | 241/172 |
| 5,346,147 | A * | 9/1994 | Ishikawa et al. | 241/172 |
| 5,497,948 | A | 3/1996 | Hockmeyer | |
| 5,549,384 | A | 8/1996 | Reynolds | |
| 6,029,915 | A | 2/2000 | Inoue | |

* cited by examiner

*Primary Examiner*—Lowell A. Larson
*Assistant Examiner*—Jason Y. Pahng
(74) *Attorney, Agent, or Firm*—Arthur Jacob

(57) ABSTRACT

Apparatus and method for dispersing solid constituents into a liquid vehicle employ an immersion mill operating in combination with a low shear mixer blade assembly which sweeps the walls of a tank containing a batch of solid constituents in a liquid vehicle to circulate the batch through the immersion mill to carry out a milling operation to establish a relatively high viscosity mixture having a high degree of uniformity. The immersion mill includes an improvement wherein a helical screw impeller is placed within a tubular inlet passage for moving the batch longitudinally through the tubular inlet passage into the immersion mill, the helical screw impeller including a helical flight extending along the length of the tubular inlet passage and having a diameter complementary to the diameter of the tubular inlet passage and a pitch less than the length of the tubular inlet passage such that the helical flight spans the diameter of the tubular inlet passage along plural turns of the helical flight.

6 Claims, 6 Drawing Sheets

APPARATUS AND METHOD FOR PROCESSING HIGH VISCOSITY DISPERSIONS

This is a continuation-in-part of application Ser. No. 10/356,211, filed Jan. 31, 2003 now abandoned.

The present invention relates generally to the dispersion of solid constituents into liquid vehicles to produce a mixture of solid constituents dispersed throughout a liquid vehicle and pertains, more specifically, to the use of an immersion, or basket mill in completing the dispersion of solid materials into high viscosity liquids to form higher viscosity mixtures having a high degree of uniformity and quality, preferably in an apparatus and method requiring only a single mixing vessel, and to an improvement in an immersion mill.

Typically, in current conventional processes for dispersing solid material into a liquid vehicle to form a high viscosity mixture, that is, a mixture having a viscosity of at least about 5,000 centipoise, dispersion is accomplished utilizing a combination of machines and processes. Initially, a pre-mixer disperses solid material, usually in the form of solid powders, into a liquid held in a mixing tank, utilizing high-speed blades for shearing and low-speed blades for turnover into the high-speed blades. Once dispersion has reached the limits of the capability of the pre-mixer, the mixture is transferred from the mixing tank to a vertical or a horizontal bead mill, using an extrusion press and a pump to feed the bead mill. Upon exiting the bead mill, the mixture is fed into a second mixing tank which then is moved to another extrusion press where the second mixing tank usually is lifted to a height sufficient to enable the contents to be extruded downwardly onto a roller mill for final shearing and then de-aeration. The mixture then is discharged from the roller mill into yet another tank and placed in yet another extrusion press which feeds a filling machine. Some manufacturers choose to omit the bead mill and feed the mixture directly from the pre-mixer to the roller mill, although that procedure typically adds significantly more time to the entire process in that additional passes are required in order to attain the high degree of uniformity and quality sought. Such multiple passes through a roller mill often extends the dispersion time from hours into days. Thus, conventional processes are relatively slow and expensive, and they are potentially dangerous in that in many instances operators are exposed to possible injury from high speed rotating rolls.

Immersion mills, also known as basket mills, have been shown to accomplish a more rapid dispersion in the production of mixtures exhibiting a high degree of uniformity and quality; however, immersion mills have been limited to operating with relatively low viscosity mixtures, that is, mixtures having a viscosity below about 5,000 centipoise. That limit is imposed by the inability of an immersion mill to draw a thick mixture off the bottom and side walls of a mixing tank, the inability to force a thick mixture through the bead field and the separation screen of the immersion mill, and the inability to maintain a flow throughout the batch of thick mixture outside the immersion mill sufficient to ensure that the entire contents of the mixing tank are treated uniformly by the immersion mill, while simultaneously maintaining a controlled, essentially uniform temperature within the batch of material in the mixing tank.

The present invention provides apparatus and method in which the above-outlined shortcomings of immersion mills are overcome so that the rapid and effective dispersion accomplished by an immersion mill in the processing of relatively low viscosity mixtures is realized in connection with the processing of relatively high viscosity mixtures, enabling the production of relatively high viscosity mixtures exhibiting a high degree of uniformity and quality, while reducing the time required to form such mixtures. As such, the present invention attains several objects and advantages, some of which are summarized as follows: Enables increased effectiveness in the dispersion of solid constituents into high viscosity liquids in the formation of relatively higher viscosity mixtures having a high degree of uniformity and quality; accomplishes the dispersion of solid powders into high viscosity liquids to form higher viscosity mixtures with increased speed, as well as with a high degree of uniformity; enables the dispersion of solid powders into high viscosity liquids to form higher viscosity mixtures in a batch of material processed in a single mixing vessel without the necessity for transferring the batch from the mixing vessel in order to complete the process; allows a batch of material to be processed fully to form a higher viscosity mixture in a single mixing vessel retained at a single processing station; attains increased quality in a higher viscosity mixture having a higher degree of uniformity throughout a full batch processed in a single vessel; allows processing of the batch in a single vessel under sub-atmospheric conditions, as well as under atmospheric conditions, so as to accomplish full processing of the batch within the single vessel; enables better control over the processing of a batch of material to accomplish effective dispersion and the formation of a higher viscosity mixture of controlled higher quality; conserves time and resources in the production of high quality dispersions in relatively high viscosity mixtures having a high degree of uniformity; takes advantage of the attributes of immersion mills in the dispersion of solid constituents into high viscosity liquids to form relatively higher viscosity mixtures having a high degree of uniformity; provides simplified apparatus and procedure for producing relatively high viscosity mixtures of better uniformity and higher quality in less time; enables the production of high viscosity mixtures of solid constituents in liquid vehicles with increased ease and decreased expense.

The above objects and advantages, as well as further objects and advantages, are attained by the present invention which may be described briefly as apparatus for dispersing solid constituents into a liquid vehicle to form a relatively high viscosity mixture having a high degree of uniformity, the apparatus comprising: a mixing tank for containing a batch of solid constituents and liquid vehicle; a high shear impeller assembly for immersion in the batch contained within the mixing tank; a low shear mixer blade assembly for immersion in the batch contained within the mixing tank; an immersion mill for immersion in the batch contained within the mixing tank; controllers for operating the high shear impeller assembly simultaneous with operation of the low shear mixer blade assembly in the batch within the mixing tank in a dispersion operation wherein the low shear mixer blade assembly directs the batch to the high shear impeller assembly to disperse the solid constituents in the liquid vehicle and establish an essentially homogeneous mixture of solid constituents and liquid vehicle in the batch in the mixing tank, and subsequently operating the immersion mill simultaneous with the low shear mixer blade assembly in the mixture within the mixing tank in a milling operation wherein the low shear mixer blade assembly directs the batch to the immersion mill within the mixing tank to mill and further disperse the solid constituents in the liquid vehicle in the mixing tank to form the relatively high viscosity mixture having a high degree of uniformity; a sealing arrangement for closing the tank and sealing the tank against atmospheric pressure to enable operations within the tank to be conducted under reduced pressure relative to atmospheric pressure; the immersion mill including a tubular inlet passage for receiving the batch during the milling operation, the tubular inlet passage having an inlet end, an outlet end, and a diameter along a length extending between the inlet end and the outlet end; and a helical screw impeller within the tubular inlet passage for moving the batch longitudinally through the tubular inlet passage into the immersion mill, the helical screw impeller including a helical flight extending along the length of the tubular inlet passage and having a diameter complementary to the diameter of the tubular inlet passage and a pitch less than the length of the tubular inlet passage such that the helical flight spans the diameter of the tubular inlet passage along plural turns of the helical flight.

In addition, the present invention includes apparatus for dispersing solid constituents into a liquid vehicle to form a relatively high viscosity mixture having a high degree of uniformity, the apparatus comprising: a mixing tank for containing a batch of solid constituents and liquid vehicle; a low shear mixer blade assembly for immersion in the batch contained within the mixing tank; an immersion mill for immersion in the batch contained within the mixing tank; controllers for operating the immersion mill simultaneous with the low shear mixer blade assembly in the mixture within the mixing tank in a milling operation wherein the low shear mixer blade assembly directs the batch to the immersion mill within the mixing tank to mill and disperse the solid constituents in the liquid vehicle in the mixing tank to form the relatively high viscosity mixture having a high degree of uniformity; a sealing arrangement for closing the tank and sealing the tank against atmospheric pressure to enable operations within the tank to be conducted under reduced pressure relative to atmospheric pressure; the immersion mill including a tubular inlet passage for receiving the batch during the milling operation, the tubular inlet passage having an inlet end, an outlet end, and a diameter along a length extending between the inlet end and the outlet end; and a helical screw impeller within the tubular inlet passage for moving the batch longitudinally through the tubular inlet passage into the immersion mill, the helical screw impeller including a helical flight extending along the length of the tubular inlet passage and having a diameter complementary to the diameter of the tubular inlet passage and a pitch less than the length of the tubular inlet passage such that the helical flight spans the diameter of the tubular inlet passage along plural turns of the helical flight.

Further, the present invention provides an improvement in an immersion mill having a basket, media within the basket, and a tubular inlet passage for the reception of material to be processed through the media in the basket, the tubular inlet passage having an inlet end, an outlet end, and a diameter along a length extending between the inlet end and the outlet end, the improvement comprising: a helical screw impeller within the tubular inlet passage for moving the batch longitudinally through the tubular inlet passage into the immersion mill, the helical screw impeller including a helical flight extending along the length of the tubular inlet passage and having a diameter complementary to the diameter of the tubular inlet passage and a pitch less than the length of the tubular inlet passage such that the helical flight spans the diameter of the tubular inlet passage along plural turns of the helical flight.

The invention will be understood more fully, while still further objects and advantages will become apparent, in the following detailed description of preferred embodiments of the invention illustrated in the accompanying drawing, in which.

Figure 1:
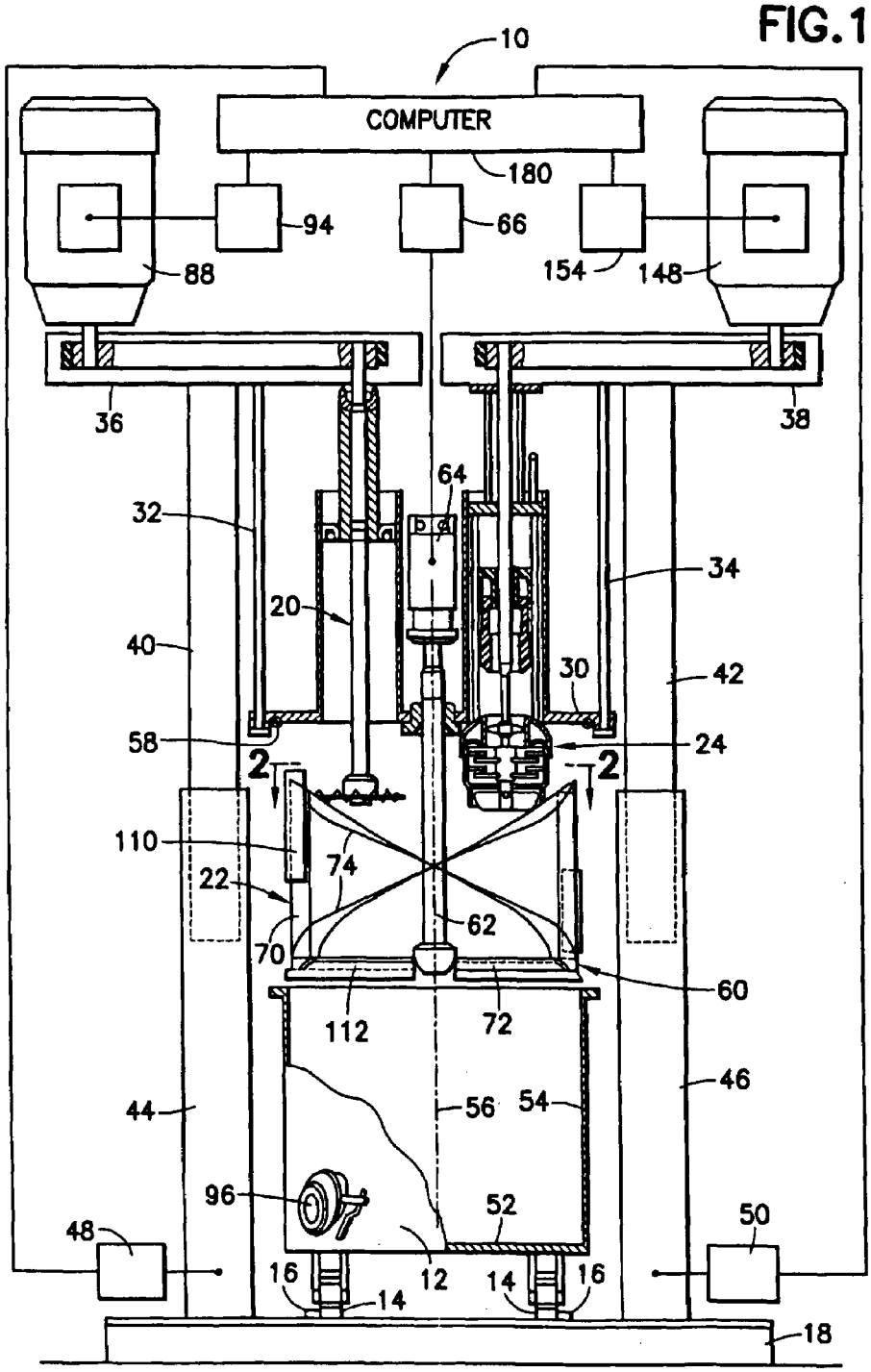
FIG. 1 is a partially schematic, diagrammatic longitudinal cross-sectional view of an apparatus constructed and operated in accordance with the present invention, showing components of the apparatus in an initial position.
Figure 2:
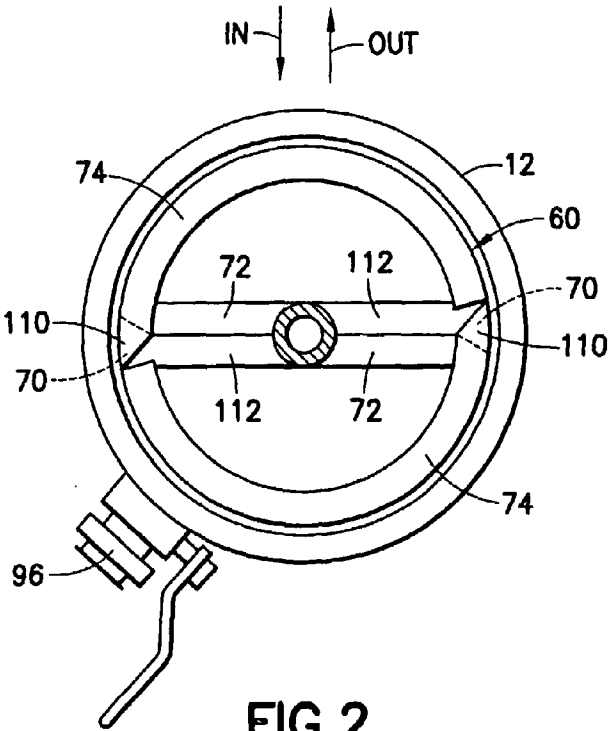
FIG. 2 is a lateral cross-sectional view taken along line 2—2 of FIG. 1.

Referring now to the drawing, and especially to FIGS. 1 and 2 thereof, apparatus constructed in accordance with the present invention is illustrated generally at 10 and is seen to include a mixing vessel in the form of a generally cylindrical mixing tank 12 supported on casters 14 engaged with tracks 16 extending along a platform 18 so that the tank 12 can be moved along the platform 18, in directions indicated by the IN and OUT arrows in FIG. 2, selectively into and out of an operating position beneath operating components of apparatus 10, as described below.

The operating components include a high shear impeller assembly 20, a low shear mixer blade assembly 22 and an immersion mill 24, all assembled with a tank cover 30 suspended over tank 12 by means of moving devices which include suspension rods 32 and 34 affixed respectively to overhead beams 36 and 38 each carried by a respective post 40 and 42. Posts 40 and 42 are selectively moveable upwardly and downwardly, independent of one another, by individual hydraulic lifts 44 and 46, under the control of individual lift controllers 48 and 50, posts 40 and 42 being illustrated in FIG. 1 at the uppermost limit of movement where the impeller assembly 20, the mixer blade assembly 22 and the immersion mill 24, together with cover 30, are raised above the tank 12, enabling the tank to be moved into and out of the position illustrated in FIG. 1. Tank 12 includes a bottom wall 52 and a cylindrical side wall 54 having a central axis 56 and extending upwardly from the bottom wall 52 essentially parallel to central axis 56. Cover 30 carries an annular seal 58, provided for purposes to be described below.

Figure 3:
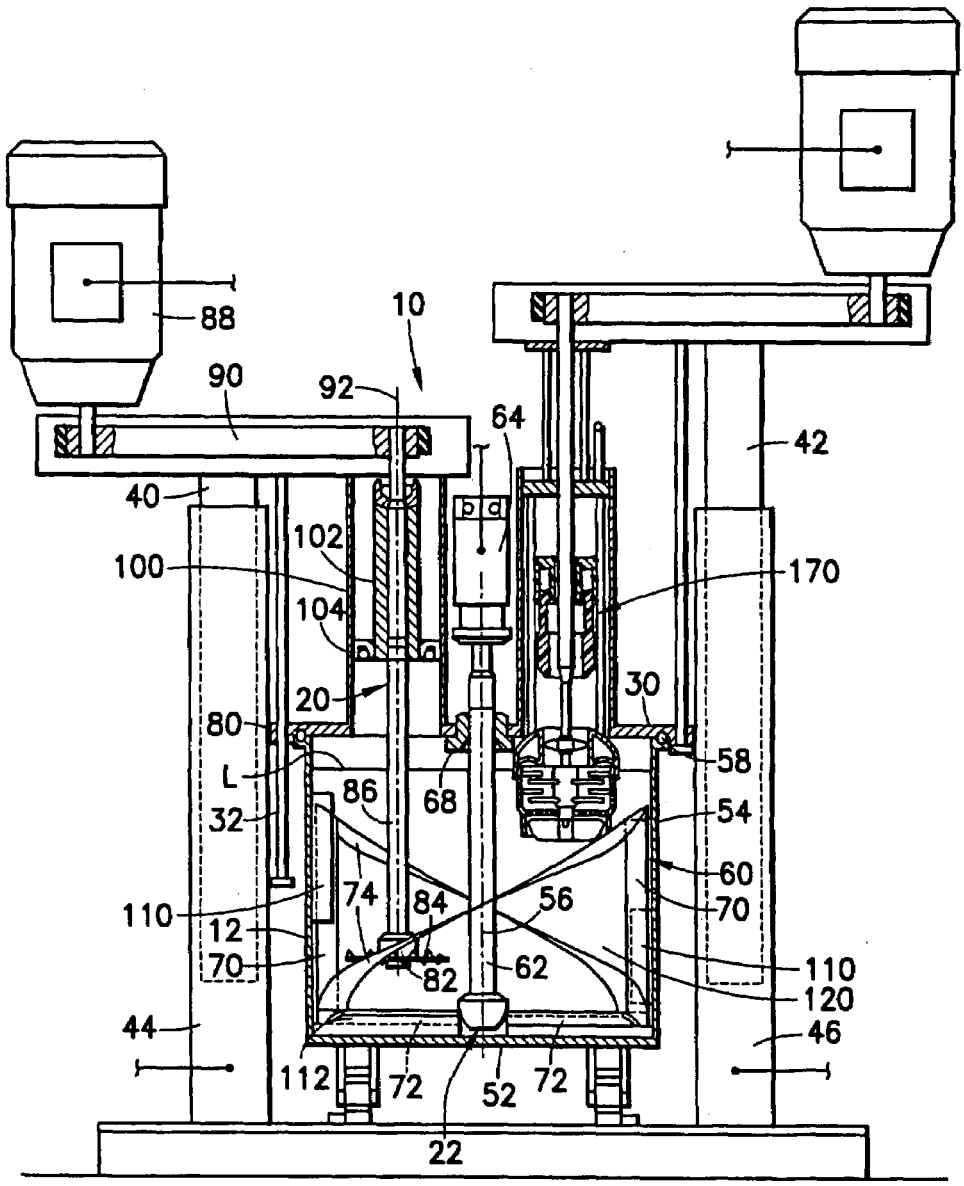
FIGS. 3 through 5 are diagrammatic longitudinal cross-sectional views similar to FIG. 1, but showing the components in different operating positions and demonstrating a method carried out in accordance with the present invention.
Figure 4:
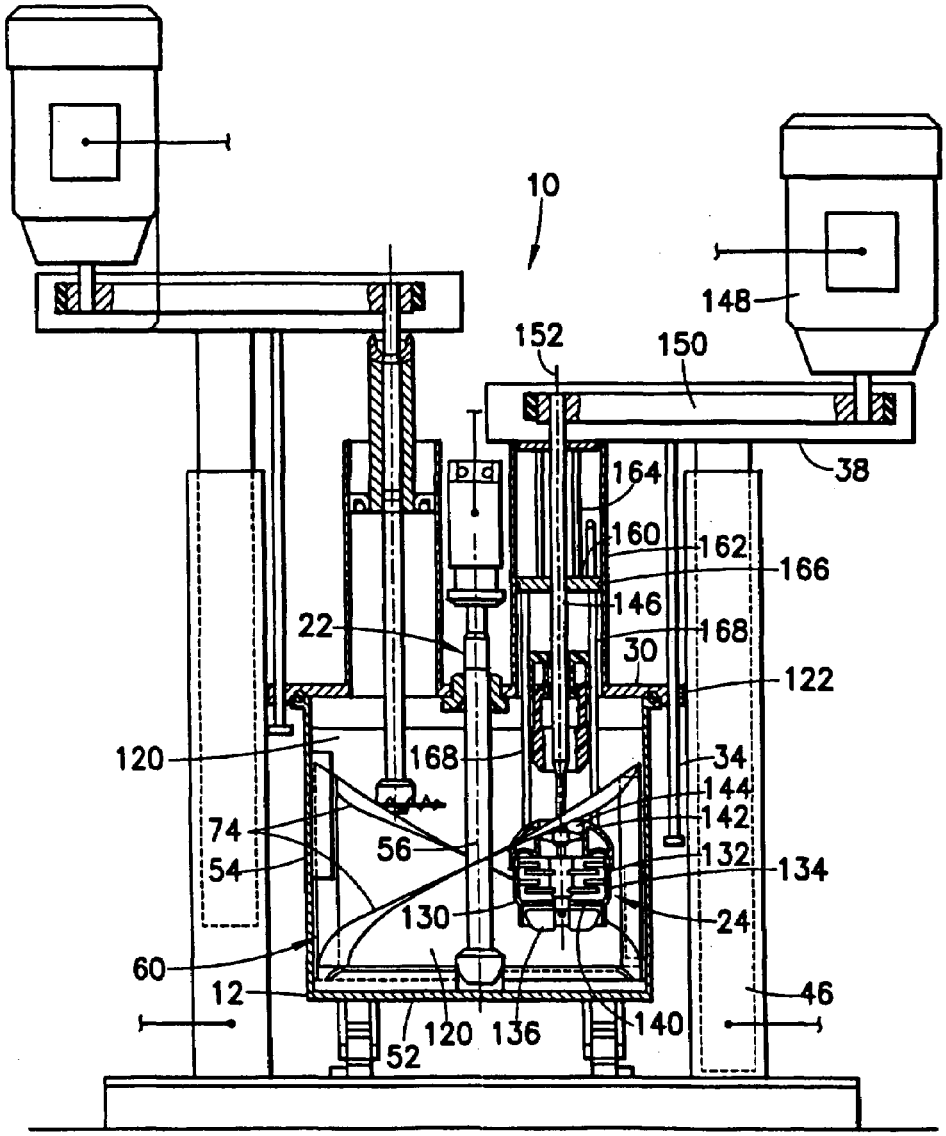
Figure 5:
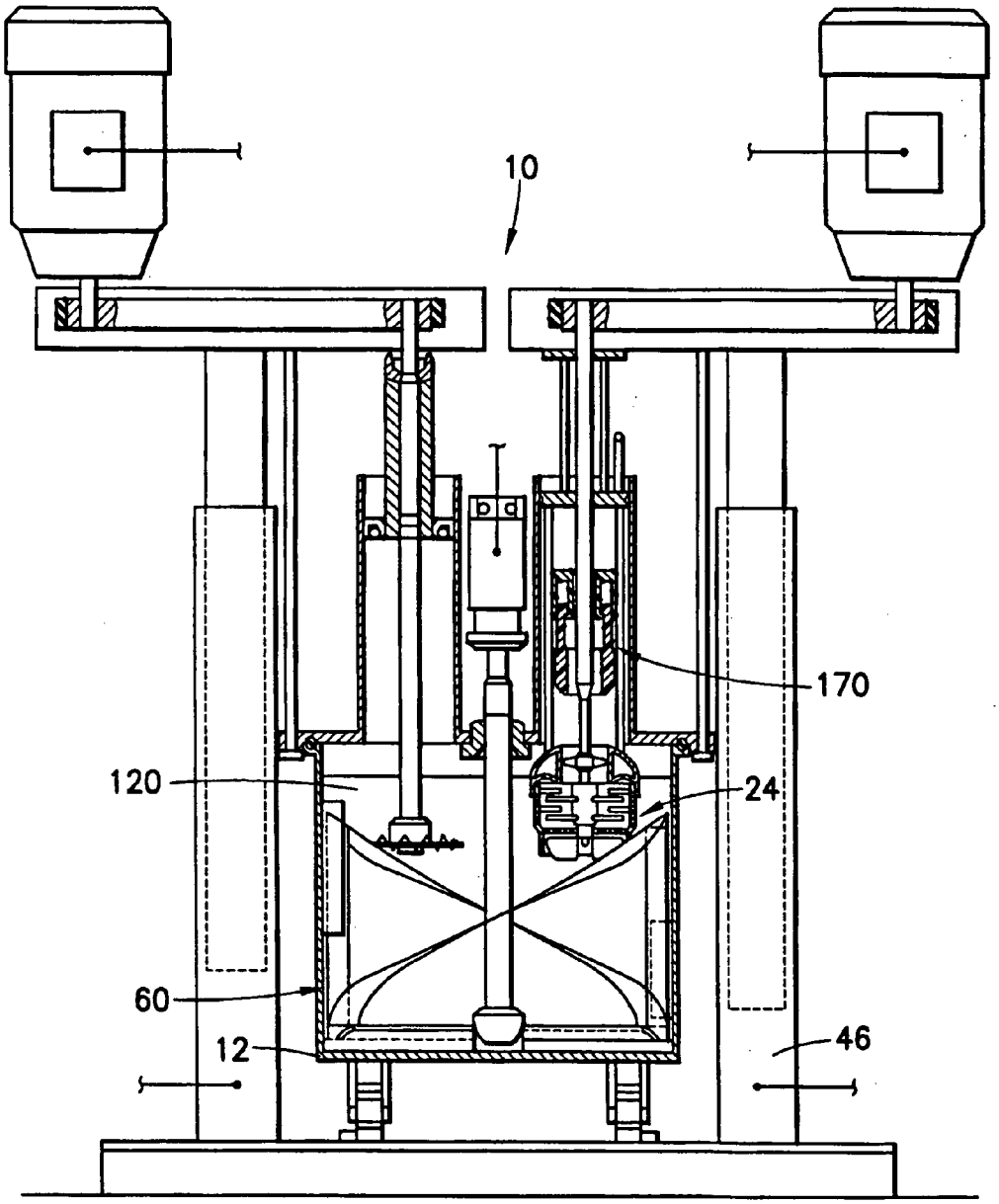

Turning now to FIGS. 3 through 5, viewed in connection with FIGS. 1 and 2, with tank 12 filled up to a level L with a liquid vehicle and placed in position beneath the operating components, as described above in connection with FIG. 1, solid constituents are introduced into the liquid vehicle to begin the process of dispersing the solid constituents into the liquid vehicle. As seen in FIG. 3, cover 30 is lowered, by operation of both hydraulic lifts 44 and 46, until the cover 30 and seal 58 engage the upper end of the side wall 54 of tank 12, thus providing a sealing arrangement which enables the cover 30 to close and seal the tank 12 against atmospheric pressure.

At the same time, the low shear mixer blade assembly 22 is lowered to the operating position illustrated in FIG. 3. The mixer blade assembly 22 includes a sweeper blade assembly 60 mounted at the lower end of a drive shaft 62 for rotation with the drive shaft 62 driven by a drive motor 64 connected to the upper end of the drive shaft 62 and controlled by a controller 66. A bearing 68 couples the drive shaft 62 to the cover 30 for movement up and down with the cover 30, while enabling rotation of the drive shaft 62 relative to the cover 30. The drive shaft 62 is aligned along central axis 56 of the tank 12, and the sweeper blade assembly 60 includes first blades spaced radially from the drive shaft 62 and second blades extending between the drive shaft 62 and the first blades. Thus, as illustrated in FIGS. 2 and 3, the first blades include essentially straight, axially-extending side blades 70 for extending along the side wall 54 of the tank 12, while the second blades include radially-extending bottom blades 72 extending along the bottom wall 52 of the tank 12, between the drive shaft 62 and the axially-extending blades 70. In addition, the first blades include helical blades 74 extending adjacent the side wall 54 of the tank 12, from the lower end of one blade 70 to the upper end of the other blade 70, for purposes to be described below.

Continued downward movement of post 40 by the hydraulic lift 44 lowers the high shear impeller assembly 20, by virtue of a lost-motion connection 80 between suspension rod 32 and cover 30, until impeller 82 of the impeller assembly 20 is located adjacent the bottom wall 52 of tank 12, as seen in FIG. 3. Impeller 82 includes high speed shearing blades 84 and is coupled to a drive shaft 86 driven by a drive motor 88, through a drive train 90, for rotation about a high shear impeller axis 92. Impeller axis 92 is essentially parallel to and spaced laterally from the central axis 56, and the impeller 82 then is located within the sweeper blade assembly 60, with the impeller axis 92 and the impeller 82 spaced laterally from the central axis 56 and drive shaft 62, and from the first blades of the sweeper blade assembly 60, and spaced upwardly somewhat from the second blades of the sweeper blade assembly 60, adjacent the bottom wall 52 of the tank 12. A controller 94 controls the drive motor 88 for high speed rotation of the impeller 82.

Once the low shear mixer blade assembly 22 and the high shear impeller assembly 20 are in place, as illustrated in FIG. 3, a dispersion operation is commenced in which initial dispersion of solid material in the liquid vehicle is accomplished by simultaneous rotation of the impeller 82 and the sweeper blade assembly 60. While this initial dispersion can be carried out under atmospheric pressure, in the preferred process the sealed interior of the tank 12 is placed under sub-atmospheric pressure, that is, under a reduced pressure relative to atmospheric pressure, often referred to as under vacuum, and the solid constituents are introduced in the form of solid powder metered through a valved port 96 near the bottom wall 52 of the tank 12 and adjacent the impeller 82. In order to maintain the interior of the tank 12 sealed, the drive shaft 86 passes through a tubular sleeve 100 which is integral with the cover 30 of the tank 12, with the drive shaft 86 supported in a bearing block 102 carrying a seal 104 engaged with the sleeve 100 to maintain the interior of the tank 12 sealed.

The impeller 82 is rotated at a relatively high speed, while the sweeper blade assembly 60 is rotated at a relatively low speed. Rotation of the sweeper blade assembly 60 is in a clockwise direction, as viewed in FIGS. 2 and 3, so that the mixture of solids in liquid is moved by the helical blades 74 in a downward direction to be directed toward and into the impeller 82. The bottom blades 72 move the mixture away from the bottom wall 52 and the side blades 70 move the mixture away from the side wall 54 of the tank 12 to assure thorough mixing. To this end, blades 70 and 72 may carry self-adjusting scrapers 110 and 112, respectively, which wipe the walls 54 and 52 of the tank 12 to assist in moving all of the mixture toward the impeller 82. Rotation of the impeller 82 may be either clockwise or counter-clockwise; however, it has been found that a more effective dispersion is attained when the direction of rotation of the impeller 82 is counter to the direction of rotation of the sweeper blade assembly 60.

The initial dispersing operation, as described immediately above, accomplishes mixing of the solid constituents with the liquid vehicle to establish a batch 120 comprised of an essentially homogeneous, relatively high viscosity mixture; however, due to the limited capabilities of the high speed, high shear impeller assembly 20, the homogeneous mixture of batch 120 lacks the fine particle separation desired in the final product. Accordingly, once the initial dispersing operation is complete, rotation of the impeller 82 is discontinued and the impeller assembly 20 is raised to withdraw the impeller 82 from the lower position in the batch 120 in the tank 12. Then, the immersion mill 24 is lowered, by actuation of hydraulic lift 46, until, by virtue of a lost-motion connection 122 between suspension rod 34 and cover 30, the immersion mill 24 is immersed in the batch 120, at a location laterally between the central axis 56 and the first blades of the sweeper blade assembly 60, and adjacent the bottom wall 52 of the tank 12, spaced upwardly somewhat from the second blades of the sweeper blade assembly 60, as illustrated in FIG. 4.

Immersion mill 24 is constructed in a manner similar to that described in detail in U.S. Pat. No. 5,184,783, the disclosure of which patent is incorporated herein by reference thereto. Thus, immersion mill 24 includes a media bed 130 contained within a basket 132 having a perforated wall 134 such that solid constituents in a mixture moved through the immersion mill 24 will be milled and mixed with the liquid vehicle of the mixture to form a mixture in which the solid constituents are finely divided and more uniformly dispersed throughout the mixture. In order to move the mixture through the immersion mill 24, a lower impeller 136 is placed beneath the basket 132, adjacent an outlet 140, and an upper impeller 142 is placed above the basket 132, adjacent an inlet 144 to the basket 132. The impellers 136 and 142 are affixed to a drive shaft 146 coupled to a drive motor 148 through a drive train 150 for rotation about a mill axis 152 essentially parallel to and spaced from the central axis 56, and a controller 154 controls actuation of the drive motor 148. Drive shaft 146 extends through a bearing block 160 engaged with a tubular sleeve 162 which is integral with cover 30. Bearing block 160 is affixed to overhead beam 38, by means of connecting rods 164, engages tubular sleeve 162 for sliding movement within the sleeve 162, and carries a seal 166 engaged with the sleeve 162 to maintain the interior of the tank 12 sealed. Immersion mill 24 is suspended from bearing block 160, by members 168, and moves upward and downward, relative to cover 30, in response to upward and downward movement of the bearing block 160.

Simultaneous operation of the immersion mill 24 and the sweeper blade assembly 60 of the mixer blade assembly 22 in a milling operation enables milling of the high viscosity homogenous mixture of batch 120 to form an even higher viscosity mixture having a high degree of uniformity. Thus, rotation of the sweeper blade assembly 60 sweeps portions of the mixture of batch 120 away from the walls 52 and 54 of the tank 12 to maintain a circulation of the entire mixture of the batch 120, assuring processing of the entire batch 120 by the immersion mill 24. Rotation of the sweeper blade assembly 60 in a counter-clockwise direction, as viewed in FIG. 4, enables the helical blades 74 to assist in maintaining a circulation which moves the mixture of batch 120 toward the inlet 144 of the immersion mill 24. In addition, the helical blades 74 tend to eliminate stratification in the batch 120, thereby enhancing the performance of the immersion mill 24. The combination of the action of the sweeper blade assembly 60 with the operation of the immersion mill 24 enables the immersion mill 24 to process the high viscosity mixture of batch 120 effectively and form the desired relatively high viscosity mixture having a high degree of uniformity, as well as increased quality. As the mixture is circulated to the inlet 144 of the immersion mill 24, the upper impeller 142 will drive the mixture into the media bed 130 of the immersion mill 24, subjecting the solid constituents of the mixture to high shear and impact. Upon exiting the immersion mill 24, the solid constituents are reincorporated rapidly into the remainder of the mixture, as assisted by the helical blades 74 of the sweeper blade assembly 60, and readily are recirculated for re-entry into the immersion mill 24 to complete the milling process. Thus, the immersion mill 24 and the sweeper blade assembly 60, and especially the helical blades 74 of the sweeper blade assembly 60, act in concert to create a highly effective, high viscosity mixture recirculation milling process carried out within the single tank 12, under atmospheric pressure.

Figure 6:
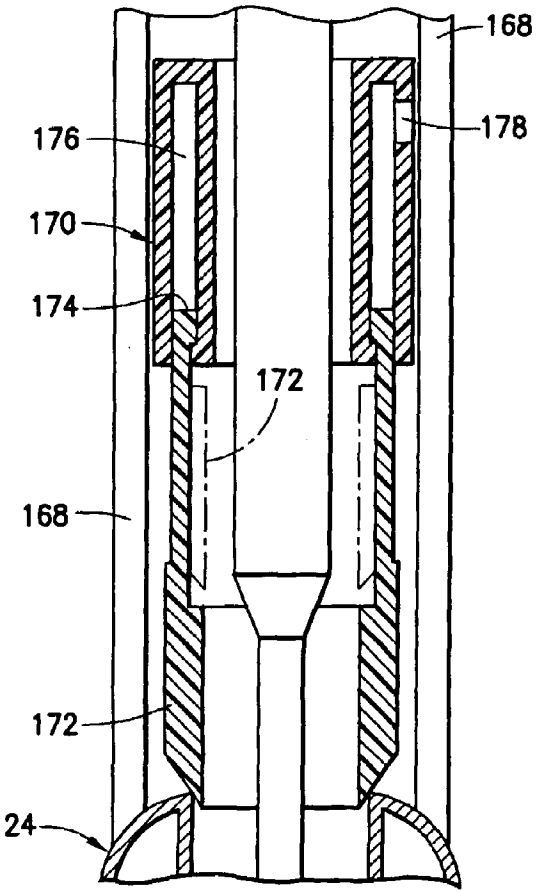
FIG. 6 is an enlarged, fragmentary view of a portion of FIG. 5, showing a detail of construction.

Turning now to FIGS. 5 and 6, upon completion of the milling operation, the immersion mill 24 is retracted, by operation of the hydraulic lift 46, to withdraw the immersion mill 24 at least partially from the batch 120. The sealed interior of the tank 12 is subjected to sub-atmospheric pressure, in the nature of a vacuum, and the batch 120 is de-aerated. In order to assist in de-aeration, the sweeper blade assembly 60 is rotated in a clockwise direction to move the mixture of the batch 120 upwardly toward the surface of the batch 120 and facilitate the escape of air from the batch 120. The measure of sub-atmospheric pressure established in the tank 12 for de-aeration is dependent upon the rheological properties of the mixture in the batch 120, typical levels being in the range of about ten to twenty-nine inches of mercury.

During the de-aeration operation, the inlet 144 of the immersion mill 24 is sealed against the sub-atmospheric pressure to avoid escape of media from the media bed 130 through the inlet 144 of the immersion mill 24. While sealing of the inlet 144 may be accomplished by manually inserting a sealing closure into inlet 144, sealing preferably is accomplished through the provision of an automated seal assembly. As seen in FIG. 6, as well as in FIG. 5, a seal assembly 170 is mounted in tubular sleeve 162, which is integral with the cover 30 of the tank 12, the seal assembly 170 being juxtaposed with the inlet 144 of the immersion mill 24. The seal assembly 170 includes a closure in the form of a plug 172 mounted for selective downward and upward movement to close the inlet 144 when in the downward position, shown in full lines in FIG. 6, and to open the inlet 144 when in the upward position, shown in phantom. The plug 172 terminates at the upper end thereof in an annular-shaped piston 174 which slides within an annular chamber 176, downwardly in response to a positive pressure introduced into the chamber 176 through a port 178, and upwardly in response to a negative pressure, or vacuum, introduced to the chamber 176 at port 178. In the downward position, the plug 172 engages the immersion mill 24 to close and seal the inlet 144. In the upward position, the plug 172 clears the inlet 144 for operation of the immersion mill 24, as described above.

Upon completion of the de-aeration operation, the finished product, processed entirely in the single tank 12 placed at a single station in apparatus 10, is ready for a final quality assessment and subsequent packaging for shipment. The need for multiple stage processing requiring the transfer of a processed batch to several different vessels and several different stations in order to accomplish the several stages of processing is eliminated by the present invention. The degree of dispersion accomplished by the present invention is at least as great as that attained through conventional processes employing separate roller mills or horizontal or vertical bead mills, and is accomplished in approximately one-third the time required to carry out such a conventional dispersion process. While all of the present operations readily are carried out by manual operation of the controllers 48, 50, 66, 94 and 154, in an appropriate sequence, the entire process may be simplified by linking the controllers to a computer 180, as seen in FIG. 1, programmed to operate the controllers in timed sequences appropriate to the particular solid constituents and liquid vehicles being mixed.

Figure 7:
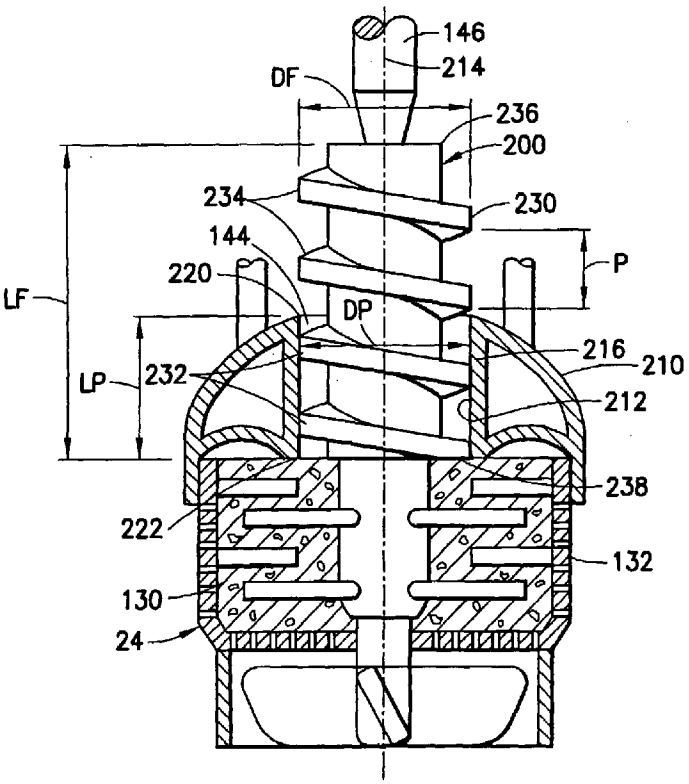
FIG. 7 is an enlarged, fragmentary view similar to a portion of FIG. 1 and showing an alternate component part of the apparatus.

Referring now to FIG. 7, as an alternate to seal assembly 170 shown in FIGS. 5 and 6, immersion mill 24 is provided with a helical screw impeller 200 affixed to drive shaft 146 and extending into inlet 144. Inlet 144 is shown within a draft tube 210 having a tubular inlet passage 212 extending along a central longitudinal axis 214 and having a cylindrical wall 216 with a diameter DP. Tubular inlet passage 212 extends from an inlet end 220 to an outlet end 222 and has a length LP between the inlet end 220 and the outlet end 222. Helical screw impeller 200 includes a helical flight 230 having a diameter DF complementary to the diameter DP of the tubular inlet passage 212 and a pitch P. The diameter DF and the pitch P are so related to the diameter DP and the length LP, respectively, as to assure that not only is the mixture moved through tubular inlet passage 212 and into the immersion mill 24 by rotation of the helical screw impeller 200, but the close fit between the helical screw impeller 200 and the wall 216 of the passage 212, together with the presence of mixture placed between plural turns 232 of the flight 230 within the passage 212, effectively seals the passage 212 against the escape of media from the media bed 130 through inlet 144. Thus, the flight 230 spans the diameter DP of passage 212 and the pitch P of the flight 230 is less than the length LP of the of the passage 212, providing plural turns 232 within the length LP of the passage 212 sufficient to assure that passage 212, and hence inlet 144, is sealed against the escape of media. A pitch P which provides about two turns 232 of helical flight 230 has been found to be effective. It is noted that by virtue of the seal provided by helical screw impeller 200, retraction of the immersion mill 24 during de-aeration, as described above in connection with FIGS. 5 and 6, no longer is necessary, thus simplifying the apparatus and procedure, as well as expediting the entire process.

In the preferred construction, helical screw impeller 200 has a length LF greater than the length LP of the passage 212 and provides plural turns 234 outside of passage 212, above passage 212, and leading to the inlet end 220 of passage 212. Thus, about two turns 234 adjacent upper end 236 of helical screw impeller 200 assist in moving mixture into the passage 212. In particular, the higher viscosity material in the mixture above immersion mill 24 is drawn into helical screw impeller 200 and is moved by the helical screw impeller 200 along passage 212 and into basket 132 of the immersion mill 24, thereby increasing the pressure within the basket 132 and increasing the flow rate through the media bed 130 within the basket 132. In this manner greater uniformity is attained in the batch 120 in less time, enabling a substantial reduction in cycle time for processing the batch 120. Lower end 238 of helical screw impeller 200 does not extend beyond the outlet end 222 of passage 212 so that helical flight 230 extends longitudinally from the inlet end 220 toward the outlet end 222 and longitudinally no farther than the outlet end 222. In this manner, helical screw impeller 200 remains above the media bed 130 and does not disturb the media within the media bed 130.

Figure 8:
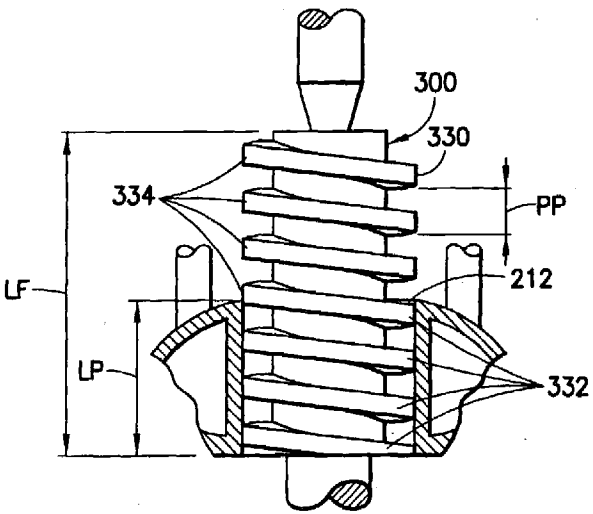
FIG. 8 is a fragmentary view similar to a portion of FIG. 7 and showing another alternate component part.

Turning to FIG. 8, as well as to FIG. 7, an alternate helical screw impeller 300 is shown placed within passage 212. Helical screw impeller 300 includes a helical flight 330 having a pitch PP less than pitch P of the helical flight 230 of the helical screw impeller 200 described above in connection with the embodiment of FIG. 7. Thus, over the same length LF as helical screw impeller 200, helical screw impeller 300 includes a greater number of turns in helical flight 330, enabling the placement of about three to four turns 332 within passage 212, and about three to four turns 334 outside of passage 212. The availability of different pitches, such as pitch P or pitch PP, and corresponding different numbers of turns of the helical flights 230 and 330 along the respective helical screw impellers 200 and 300, enables increased versatility in accommodating the processing of a wider variety of mixtures.

It will be seen that the present invention attains the several objects and advantages summarized above, namely: Enables increased effectiveness in the dispersion of solid constituents into high viscosity liquids in the formation of relatively higher viscosity mixtures having a high degree of uniformity and quality; accomplishes the dispersion of solid powders into high viscosity liquids to form higher viscosity mixtures with increased speed, as well as with a high degree of uniformity; enables the dispersion of solid powders into high viscosity liquids to form higher viscosity mixtures in a batch of material processed in a single mixing vessel without the necessity for transferring the batch from the mixing vessel in order to complete the process; allows a batch of material to be processed fully to form a higher viscosity mixture in a single mixing vessel retained at a single processing station; attains increased quality in a higher viscosity mixture having a higher degree of uniformity throughout a full batch processed in a single vessel; allows processing of the batch in a single vessel under sub-atmospheric conditions, as well as under atmospheric conditions, so as to accomplish full processing of the batch within the single vessel; enables better control over the processing of a batch of material to accomplish effective dispersion and the formation of a higher viscosity mixture of controlled higher quality; conserves time and resources in the production of high quality dispersions in relatively high viscosity mixtures having a high degree of uniformity; takes advantage of the attributes of immersion mills in the dispersion of solid constituents into high viscosity liquids to form relatively higher viscosity mixtures having a high degree of uniformity; provides simplified apparatus and procedure for producing relatively high viscosity mixtures of better uniformity and higher quality in less time; enables the production of high viscosity mixtures of solid constituents in liquid vehicles with increased ease and decreased expense.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in an immersion mill having a basket, media within the basket, and a tubular inlet passage for the reception of material to be processed through the media in the basket, the tubular inlet passage having an inlet end, an outlet end, and a diameter along a length extending between the inlet end and the outlet end, the improvement comprising:

a helical screw impeller within the tubular inlet passage for moving the material longitudinally through the tubular inlet passage into the immersion mill, the helical screw impeller including a helical flight extending along the length of the tubular inlet passage and having a diameter complementary to the diameter of the tubular inlet passage and a pitch less than the length of the tubular inlet passage such that the helical flight spans the diameter of the tubular inlet passage along plural turns of the helical flight for sealing the inlet passage against the escape of media from the basket through the inlet passage.

2. The apparatus of claim 1 wherein the plural turns of the helical flight extend longitudinally from the inlet end toward the outlet end of the tubular inlet passage and longitudinally no farther than the outlet end.

3. An improvement in an immersion mill having a basket, media within the basket, and a tubular inlet passage for the reception of material to be processed through the media in the basket, the tubular inlet passage having an inlet end, an outlet end, and a diameter along a length extending between the inlet end and the outlet end, the improvement comprising:

a helical screw impeller within the tubular inlet passage for moving the material longitudinally through the tubular inlet passage into the immersion mill, the helical screw impeller including a helical flight extending along the length of the tubular inlet passage and having a diameter complementary to the diameter of the tubular inlet passage and a pitch less than the length of the tubular inlet passage such that the helical flight spans the diameter of the tubular inlet passage along plural turns of the helical flight, the helical flight including further plural turns extending outside the inlet end of the tubular inlet passage, adjacent the inlet end.

4. An improvement in an immersion mill having a basket, media within the basket, and a tubular inlet passage for the reception of material to be processed through the media in the basket, the tubular inlet passage having an inlet end, an outlet end, and a diameter along a length extending between the inlet end and the outlet end, the improvement comprising:

a helical screw impeller within the tubular inlet passage for moving the material longitudinally through the tubular inlet passage into the immersion mill, the helical screw impeller including a helical flight extending along the length of the tubular inlet passage and having diameter complementary to the diameter of the tubular inlet passage and a pitch less than the length of the tubular inlet passage such that the helical flight spans the diameter of the tubular inlet passage along plural turns of the helical flight, the plural turns of the helical flight extending longitudinally from the inlet end toward the outlet end of the tubular inlet passage and longitudinally no farther than the outlet end, and the helical flight including further plural turns extending outside the inlet end of the tubular inlet passage, adjacent the inlet end.

5. The apparatus of claim 1 wherein the plural turns of the helical flight include two to four turns.

6. An improvement in an immersion mill having a basket, media within the basket, and a tubular inlet passage for the reception of material to be processed through the media in the basket, the tubular inlet passage having an inlet end, an outlet end, and a diameter along a length extending between the inlet end and the outlet end, the improvement comprising:

a helical screw impeller within the tubular inlet passage for moving the material longitudinally through the tubular inlet passage into the immersion mill, the helical screw impeller including a helical flight extending along the length of the tubular inlet passage and having a diameter complementary to the diameter of the tubular inlet passage and a pitch less than the length of the tubular inlet passage such that the helical flight spans the diameter of the tubular inlet passage along plural turns of the helical flight, the helical flight including two to four further turns extending outside the inlet end of the tubular inlet passage, adjacent the inlet end.

* * * * *